US007074067B2

(12) United States Patent
Yang et al.

(10) Patent No.: US 7,074,067 B2
(45) Date of Patent: Jul. 11, 2006

(54) CARD EDGE CONNECTOR WITH LATCHING ARMS

(75) Inventors: Xiang-Qi Yang, Kunsan (CN); Xiao-Gao Yang, Kunsan (CN); Ren-Chih Li, Tu-Chen (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 11/155,363

(22) Filed: Jun. 17, 2005

(65) Prior Publication Data

US 2006/0094277 A1 May 4, 2006

(30) Foreign Application Priority Data

Nov. 4, 2004 (CN) ..... 2004 1 0065627

(51) Int. Cl.
*H01R 13/625* (2006.01)

(52) U.S. Cl. ..... 439/326; 439/328

(58) Field of Classification Search ..... 439/328, 439/326, 637, 540.1, 94
See application file for complete search history.

(56) References Cited

U.S. PATENT DOCUMENTS 5,779,494 A 7/1998 Ito et al.
5,997,332 A * 12/1999 Choy ..... 439/328
6,162,069 A * 12/2000 Choy ..... 439/92
6,164,998 A * 12/2000 Poi et al. ..... 439/326
6,319,035 B1 * 11/2001 Choy ..... 439/326
6,419,513 B1 7/2002 Choy
6,948,964 B1 * 9/2005 Lee ..... 439/328

FOREIGN PATENT DOCUMENTS

WO WO 97/03484 1/1997

* cited by examiner

*Primary Examiner*—Tulsidas C. Patel
*Assistant Examiner*—Phuongchi Nguyen
(74) *Attorney, Agent, or Firm*—Wei Te Chung

(57) ABSTRACT

A card edge connector (100) comprises an insulative housing (1) defining a central slot (10) with a plurality of contacts (2) by two sides. Two arms (3) are positioned at two opposite ends of the insulative housing. Each arm includes a plastic portion (30) and a metal portion (31) attached to the plastic potion. The plastic portion includes a locking lug (301) and a restraint head (302). The metal portion is retained to the housing and extends inwardly a guidance stud (316) and a stop tag (317) for covering the locking lug and the restraint head respectively, and the stop tag is as high as an upper end of the guidance stud. While a card module is inserted into the central slot in a correct position and rotated downwardly to directly engage and push the guidance studs, the metal portions together with the plastic portions can be deflected outwards so that the card module is secured held.

6 Claims, 6 Drawing Sheets

CARD EDGE CONNECTOR WITH LATCHING ARMS

BACKGROUND OF THE INVENTION

1. Field of the Invention

The invention relates to electrical connectors, and particularly to a card edge connector with latching arms thereof for retaining a card module therein.

2. Description of Related Art

Primarily as a result of the expansion of memory in the computer field, techniques have become known is which semiconductor devices containing memories are mounted on card modules. In most cases, card edge connectors are used for the connection of such card modules to circuit boards. Card edge connectors have a substantially C-shaped configuration in which a pair of arms are formed in positions on both end portions of an insulating housing main body which carries numerous contacts.

One example of a latch-equipped electrical connector is disclosed in U.S. Pat. No. 5,779,494. The connector accommodates memory circuit card which has recesses located in the side edges. Two latching arms are integrally formed with a housing along side edges of the housing. Each of the latching arms carries a projection portion that is engageable with the recess of the circuit card, the projecting portion has a lower portion, an upper overhanging portion that overlies the lower portion and a tapered cam surface having a descending gradient. When the circuit card is inserted into a card slot of the housing and rotated into engagement, the interior edge of the recess of the circuit card contacts the tapered cam surface of the projecting portion to exert a force on the latching arm that causes the latching arm to deflect or move outwards and back toward the circuit card. Finally, the overhanging portions overlie a portion of the circuit card around the recesses, and the lower portions fits within and engaged the interior edges of the circuit card recesses. This connector suffers from a problem that concerns the reliability of the accommodation and holding of the circuit board in a correct place. Specifically, in the connector disclosed in the abovementioned patent, the tapered cam, the upper overhanging portion and the lower portion are at the same location, the connector allows flexing of the latching arms even in cases where the recesses of the circuit card are not accurately aligned with the tapered cam of the latching arms at the time of accommodation within the connector. Accordingly, the connector is held with in the connector by the projection portions of the latching arms, awful electrical connection between the circuit card and the connector which can not be found easily is be established, even, there is a danger that the latching arms will be deformed.

Hence, an improved card edge connector is required to overcome the disadvantages of the related art.

SUMMARY OF THE INVENTION

Accordingly, an object of the present invention is to provide a card edge connector which allows accurate accommodation and holding of card modules within the connector, and which can insure stable holding of card module therein.

In order to achieve the object set forth, a card edge connector in accordance with the present invention comprises an insulative housing defining a central slot therein for receiving a card module therein. A plurality of contacts are disposed by two sides of the central slot for electrical engagement with inserted card module. Two arms are positioned at two opposite ends of the insulative housing. Each arm comprises a plastic portion and a metal portion attached to the plastic potion. The plastic portion comprises a locking lug and a restraint head. The metal portion is retained to the insulative housing and extends inwardly a guidance stud and a stop tag for covering the locking lug and the restraint head respectively, and the stop tag is as high as an upper end of the guidance stud. While the card module is inserted into the central slot in a correct position and rotated downwardly to directly engage and push the guidance studs, the metal portions together with the plastic portions can be deflected outwards so that the card module is secured held.

Other objects, advantages and novel features of the invention will become more apparent from the following detailed description when taken in conjunction with the accompanying drawings.

DETAILED DESCRIPTION OF THE PREFERRED EMBODIMENT

Reference will now be made in detail to the preferred embodiment of the present invention.

Figure 1:
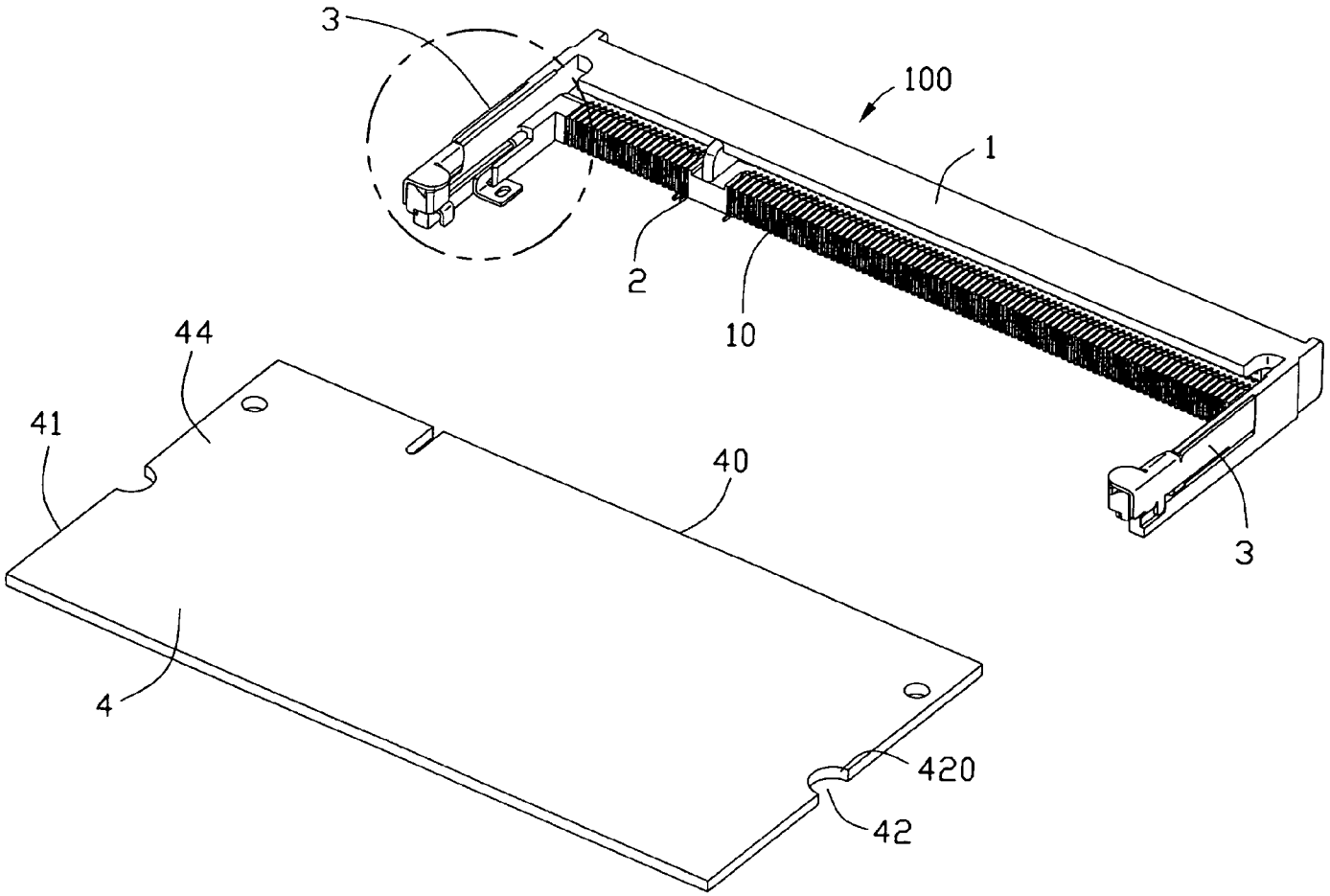
FIG. 1 is a perspective view of a card edge connector in accordance with the present invention and a card module used with the card edge connector.
Figure 2:
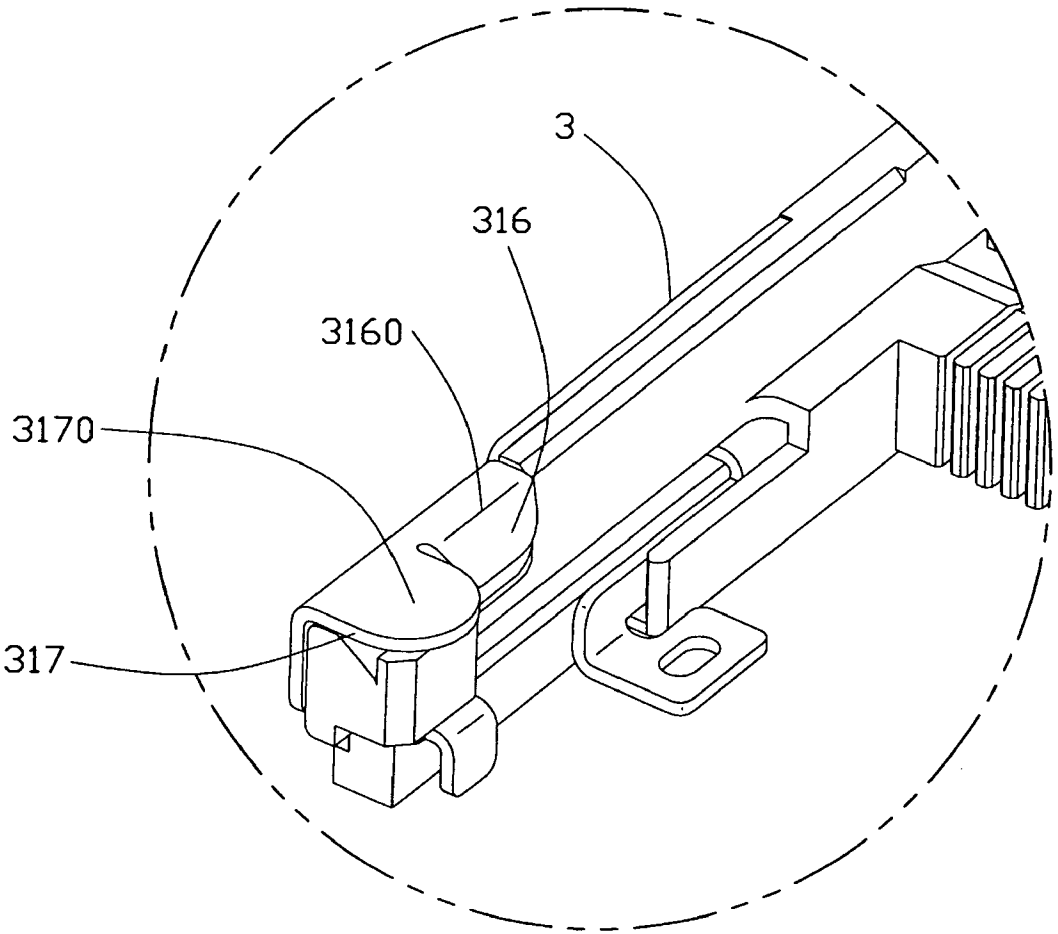
FIG. 2 is an enlarged partial perspective view of the card edge connector of FIG. 1 to show a latching arm thereof.
Figure 3:
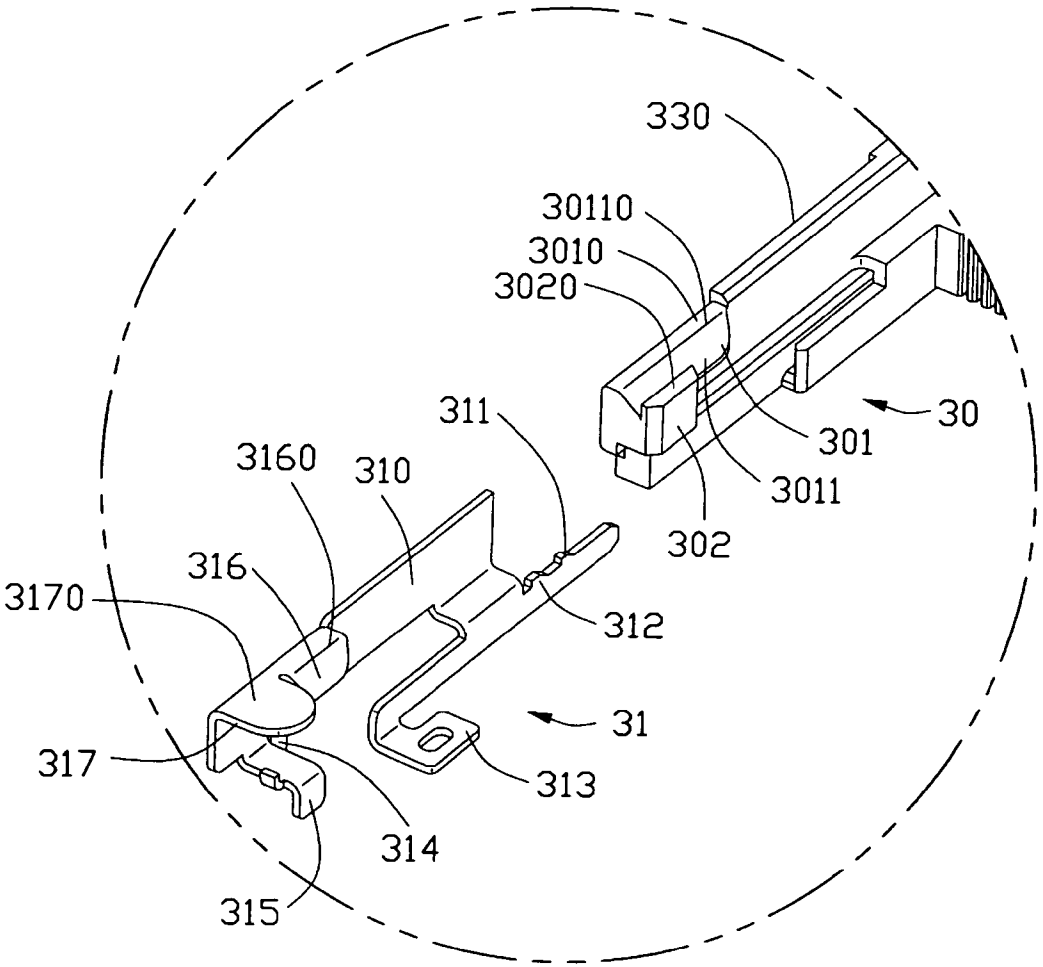
FIG. 3 is a top, exploded perspective of FIG. 2.
Figure 4:
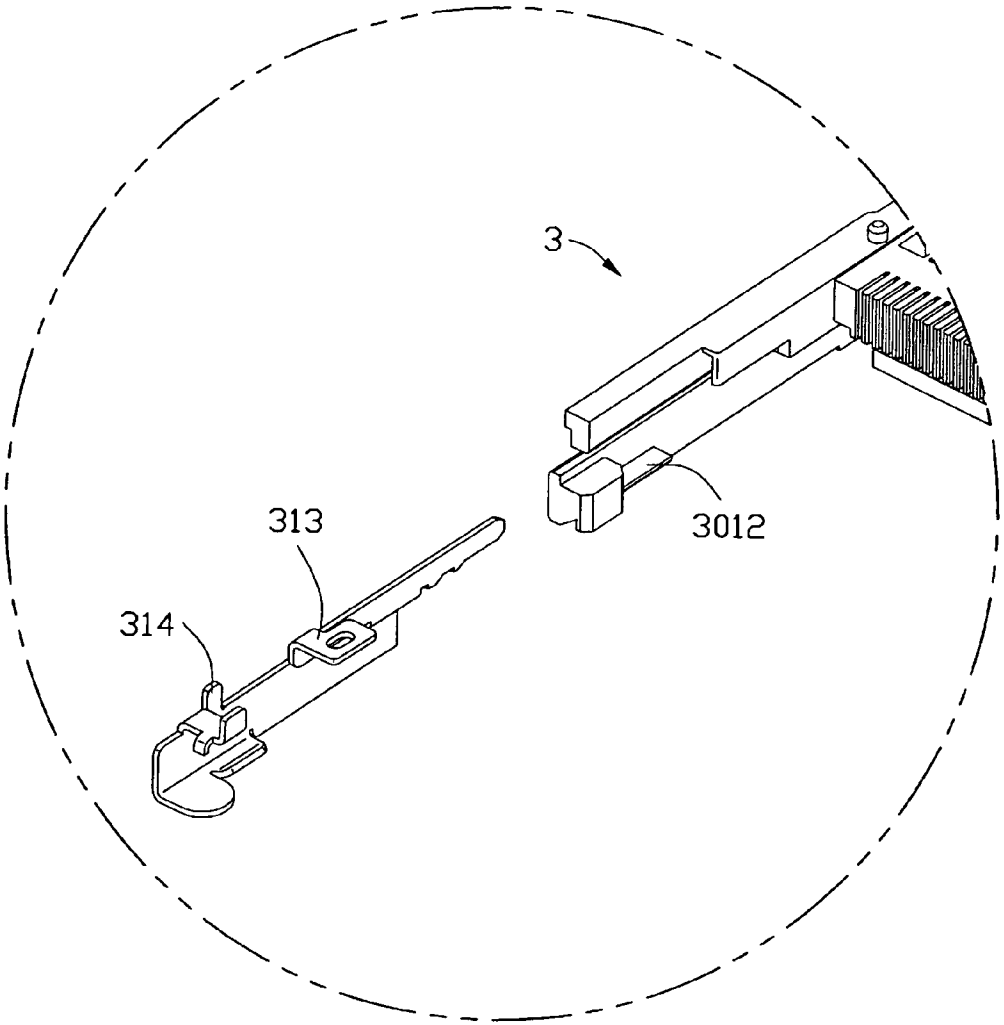
FIG. 4 is a bottom, exploded perspective of FIG. 2.

FIG. 1 shows a card edge connector 100 in accordance with the present invention for accommodating a card module 4 in a determined plane. Incidentally, the card module 4 is card-shaped and has a plurality of conductive pads (not shown is FIGS.) on top and bottom surfaces 44, 43 at an edge 40 and a pair of notch 42 at two opposite side edges 41. The card edge connector 100 comprises an insulative housing 1 and a plurality of contacts 2 received in the insulative housing 1.

Figure 5:
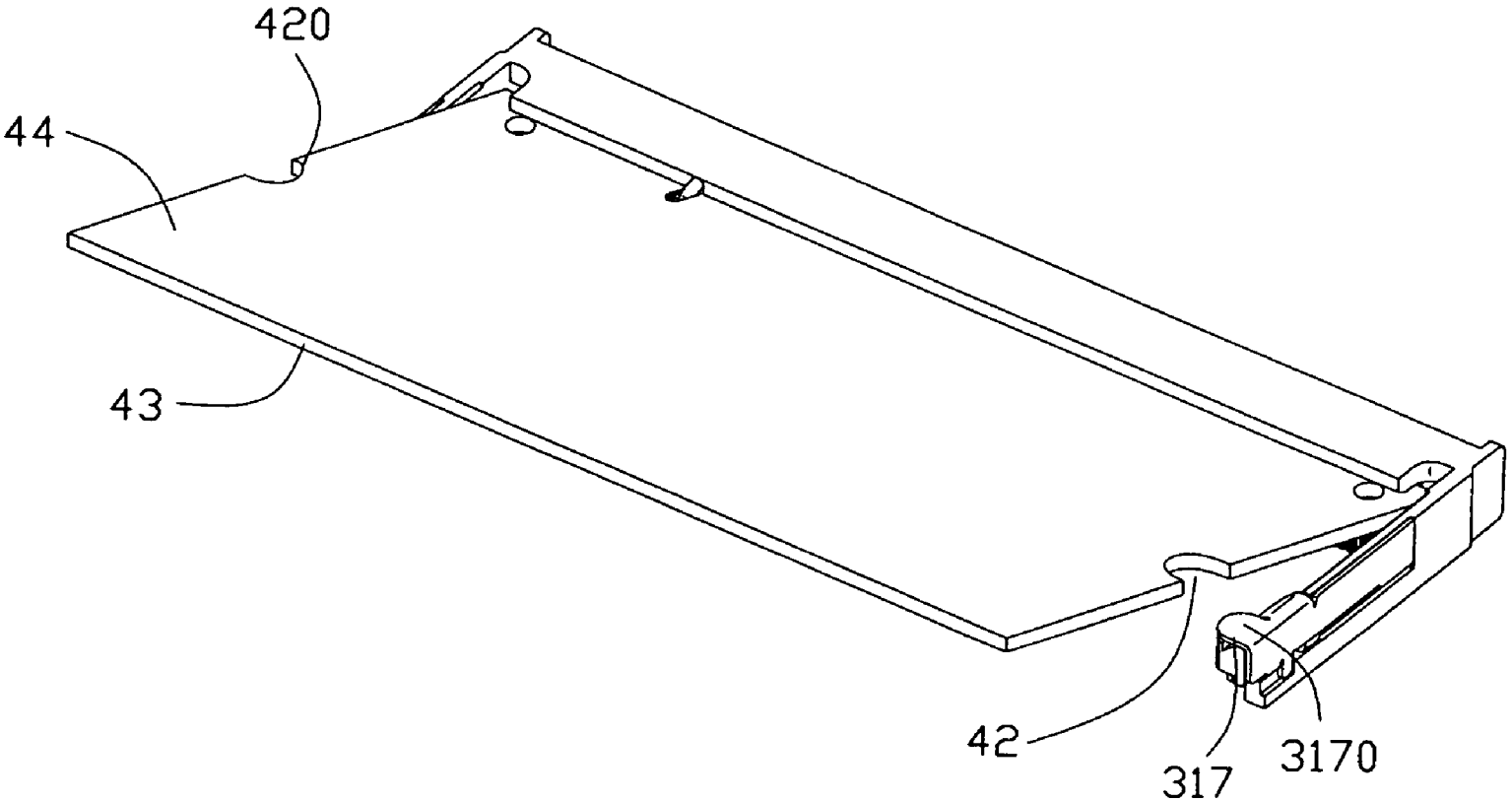
FIG. 5 is a perspective view of the card edge connector with the card module in an initial insertion position.
Figure 6:
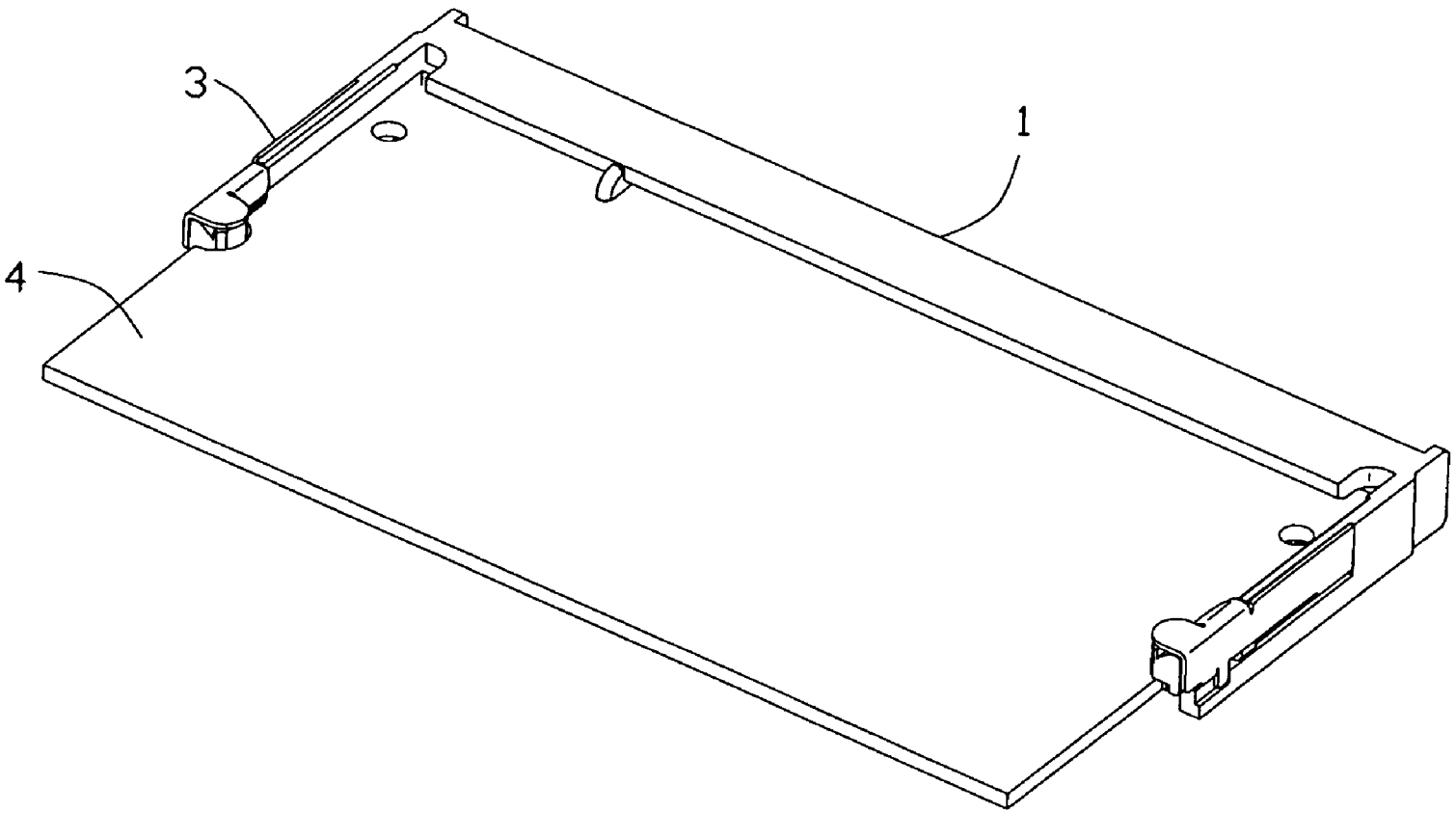
FIG. 6 is a perspective view of the card edge connector with the card module in a final horizontal position.

With reference to FIGS. 1–4, the insulative housing 1 has a base defining a central slot 10 along an elongated direction therein. The contacts 2 are disposed by two sides of the central slot 10 for respectively electrical engaging with conductive pads of the card module 4. The central slot 10 accommodates the edge 40 of the card module 4 as shown in FIGS. 5–6. Two latching arms 3 extend forwardly in a cantilevered fashion from two opposite ends of the insulative housing 1 and a space for accommodating the card module 4 is defined between two latching arms 3. The latching arms 3 are capable of outward deflection from the point at which they join the insulative housing 1 and adapted to engage the opposing side edges 41 of the card module 4 to retain the edge 40 within the central slot 10. Each latching arm 3 includes a plastic portion 30 integrally formed with the housing body and a metal portion 31 attached to the plastic portion. The plastic portion 30 includes an arm 300 with a restraint head 302 at the distal free end and a locking lug 301 adjacent to the restraint head 302. The locking lug 301 for retaining the mounted card module 4 in a final horizontal position has a first top surface 3010, an oblique surface 3011 and a retaining surface 3012. The oblique surface 3011 incline inwardly and downwardly. The restraint head 302 has a second top surface 3020 that is flush with the first top surface 3010 and the upper end of the oblique surface 3011. Both the locking lugs 301 and the restraint heads 302 project from insides of the arm 330 into the accommodating space over the determined plane and the restraint heads 302 is more projecting than the locking lugs 301.

The metal portion 31 co-moving with the plastic portion 30 includes a main body 310 and a retention section 311 extending from the main body 310. The retention section 311 connects with the main body in the middle point and has barbs 312 on one end for interferential engaged with the base of the insulative housing 1. A solder pad 313 is formed on the other end of the retention section 311. Two restriction tags 314, 315 extend downwardly from a lower side of the main body 310 for restraining the left-to-right direction of the plastic portion 30. A stop tag 317 and a guidance stud 316 adjacent to the stop tag 317 extend from an upper side of the main body 310 opposite to the restriction tags 314, 315 into the accommodating space. The stop tag 317 covers the restraint head 302, and the guidance stud 316 has a configuration in compliance with the locking lug 301 and covers the first top surface 3010, and the oblique surface 3011 in a vertical direction from the top. A distal free end of the guidance stud 316 is adjacent to the retaining surface 3012 of the plastic portion 30. In assembly, the stop tag 317 is as high as the upper end of the guidance stud 316 and the stop tag 317 is more projecting into the accommodating space than the guidance stud 316 in horizontal plane 3160.

In use, the edge 40 of the card module 4 is installed into the card edge connector 100 in an initial slanted position, shown in FIG. 5. Afterwards, the card module 4 is downwardly rotated to have the two opposite side edge 41 outwards engage the corresponding latching arms 3. During this downward rotational movement of the card module 4, if the card module is positioned in the correct position, the side edges 41 of the card module 4 around the notches 42 directly engage and impose the forces upon the guidance studs 316 of the metal portions 31 of the latching arms 3 while without direct significant improper scrapping force imposed upon the locking lug 301. The metal portion 31 together with the plastic portion 30 can smoothly outwards deflected, the notches 42 of the card module properly passed the stop tags 137, after the side edges slide off the guidance studs 316, the latching arms 3 deflected back and the card module 4 rotated downwardly to the final horizontal position, as shown in FIG. 6. The card module 4 is securely held and maintained in a prescribed position, and the restraint head 302 is received within the notch 42 of the card module 4 for restraining movement of the card module 4 relative to the card edge connector 100 along the front-to-back direction thereof, and the retaining surface 3012 of the locking lug 301 abuts against the top surface 44 for preventing inverse rotation derived from the spring forces of the contacts 2. But if the card module 4 is inserted into the central slot 10 in an inclined station and is not positioned in the correct position, afterwards, the card module 4 is downwardly rotated, the side edges 41 of the card module 4 around the notches 42 first directly engage and impose the forces upon the stop tags 317 of the metal portions 31 without contacting the guidance stud 316, the latching arms 3 can not outwards deflected, so the card module is prevented to rotate downwardly.

Understandably, similar to the traditional way, the card module 4 can be released from the card edge connector 100 by outwards deflecting the latching arms 3 to have the locking lugs 301 disengaged from the two side edge 41 of the card module 4.

In this invention, the metal portions 31 act as appended members that prevent the plastic portion excess deflection and reinforce members 3170 reinforce the strength of the plastic portion 30. Understandably, in order to achieve the object of the invention, the metal portions 31 are not necessary. To obtain the object of the invention, the latching arms of the card edge connector must have an operating/guiding sections with a guiding surface and a restraint sections for engaging with the notches of the card module, the operating/guiding sections and the restraint sections extend from the inner sides of the latching arms, the restraint sections are adjacent to the operating/guiding section and disposed on an outer end of the latching arm relative to the operating section/guiding section. In used, unless the card module is inserted in a correct position and directly engage the guiding surface of the operating/guiding sections, the latching arms can not smoothly deflected outwards.

In this embodiment, the stop tag 317 performs the stopper function for preventing the incorrect/incomplete installation of the card module. Alternatively, with removal of the tag 317, the raised type restraint head 302 also performs the same stopper function. It is noted that in comparison with U.S. Pat. No. 6,419,513 in which the restraint head is flush with the card module which performs imperfect anti-incorrect-installation function, the instant invention intentionally uses an additional projecting section, which is provided by either the stop tag 317 of the metal portion 31 or the raised type restraint head 302 of the plastic portion 30, located above the card module for perfectly performing such an anti-incorrect-installation function.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed. For example, the guidance stud may not need to be exactly compliantly same as the locking lug. The stop tag 317 can be properly higher or little lower than the upper end of the guidance stud so that the card module in correct position optimally first contact and successively substantially outwards push the guidance stud and the card module in incorrect position first directly contact the stop tag and is prevent rotating downwardly to the final position.

What is claimed is:

1. A card edge connector for receiving a card module with two notches in the opposed side edges, comprising an insulative housing defining a central slot therein; a plurality of contacts positioned beside said central slot, and a pair of deflectable latching arms disposed at two opposite ends of the insulative housing, each of said latching arm having a locking portion with a guidance surface and a restraint portion for engaging with the notches of the card module, the restraint portion located adjacent to the locking portion and nearer to a distal free end of the latching arm than the locking portion, and the latching arms being outwards deflected only when the side edges of the card module which is inserted into the central slot in a correct position directly engage with the guidance surfaces of the locking portions during downwardly rotation;

wherein a top surface of the restraint potion is as high as or higher than an upper end of the guidance surface of the locking portion;

wherein the locking portion and the restraint portion are projecting from inner sides of the latching arms over the determined plane;

wherein the locking portion has a retaining surface for engaging a top surface of the card module to hold the card module in the determined plane;

wherein a reinforcing member attached to the latching arm;

wherein the reinforcing member comprises a stop tag cover the restraint portion and a guidance stud over the locking portion in a vertical direction from the top;

wherein each latching arm comprises a plastic portion and a metal portion beside said plastic portion;

wherein the plastic portion integrally formed on the insulative housing;

wherein the metal portion further comprises a solder pad for mounting to a printed circuit board on which the connector is seated;

wherein two restriction tags extend downwardly from the main body for restraining the left-to-right direction of the plastic portion; and a stop tag and a guidance stud adjacent to the stop tag extend from the upper side of the main body, and the stop tag and the guidance stud respectively cover the guiding section and the projecting section of the latching arm; the stop tag is extending in vertical direction of the guidance stud and the main body's direction; during this downward rotational movement of the card module, if the card module is positioned in the correct position, the side edges of the card module around the notches directly engage and impose the forces upon the guidance studs of the metal portions of the latching arms while without direct significant improper scrapping force imposed upon the locking lug; the metal portion together with the plastic portion can smoothly outwards deflected, the notches of the card module properly passed the stop tags, after the side edges slide off the guidance studs, the latching arms deflected back and the card module rotated downwardly to the final horizontal position.

2. A card edge connector for assembling rotatablely a card module with notches in side edges, comprising an insulative housing having a base defining an elongated central slot for receiving an edge of the card module therein; a plurality of contacts positioned beside the central slot, and a pair of latching arms for latching the card module inside extending from two opposite ends of the base in the side of the central slot, each of latching arm comprising a guiding section and a projecting section for engaging with the notches of the card module, the guiding section and the projecting section projecting inside and higher than a determined plane in which the card module is secured held, the guiding section having an inclining surface inclining inwardly and downwardly, the projecting section adjacent to the guiding section and disposed on an outer end of the latching arm relative to the guiding section, an upper surface of the projecting section being as high as an upper end of the inclining surface;

wherein the latching arms are integrally form on the housing;

wherein a pair of reinforcing members secured to the housing and attached to the latching arms, the reinforcing member are arranged to co-move with the latching arms;

wherein the reinforcing members are made from metal plates, comprises a main body and a retention section extending from the main body;

wherein the retention section has barbs thereon for interferential engaged with the housing body and a solder pad formed on the other end of the retention section;

wherein two restriction tags extend downwardly from the main body for restraining the left-to-right direction of the plastic portion; and a stop tag and a guidance stud adjacent to the stop tag extend from the upper side of the main body, and the stop tag and the guidance stud respectively cover the guiding section and the projecting section of the latching arm; the stop tag is extending in vertical direction of the guidance stud and the main body's direction; during this downward rotational movement of the card module, if the card module is positioned in the correct position, the side edges of the card module around the notches directly engage and impose the forces upon the guidance studs of the metal portions of the latching arms while without direct significant improper scrapping force imposed upon the locking lug; the metal portion together with the plastic portion can smoothly outwards deflected, the notches of the card module properly passed the stop tags, after the side edges slide off the guidance studs, the latching arms deflected back and the card module rotated downwardly to the final horizontal position.

3. The card edge connector as described as claim 2, wherein the stop tag is as high as an upper end of the guidance stud and higher than the other part of the guidance stud.

4. A card edge connector assembly, comprising an insulative housing defining an elongated receiving slot with a plurality of contacts beside said slot; a pair of deflectable latch arms extending from two opposite lengthwise ends of the housing, each of said latch arms defining a locking lug and a restraint head adjacent to and in front of said locking lug; and a daughter board being assembled to the housing via rotation to have an edge inserted into the slot and have electrical pads around said edge in contact with the contacts when said daughter board is locked in a horizontal position, the restraint head being dimensioned to be snugly compliant with but not larger than a corresponding notch of the daughter board in a top view, said locking lug being positioned above the daughter board and engaging an upper edge face of said daughter board when said daughter board is in the horizontal position; and a pair of metallic pieces each attached to the corresponding latch arm and co-movable with the latch arm for reinforcement, wherein at least one of said metallic piece and said restraint head is equipped with a projection section which is essentially snugly compliant with the notch of the daughter board in the top view but being located above the daughter board with a distance when said daughter board is in the horizontal position for performing a stopper function during an incorrect installation of the daughter board so that the daughter board can not deflect the latch arm outward for rotative installation if the daughter board is not correctly and completely inserted into the slot due to said projection section;

wherein said projection section is a stop tag extending from the metallic piece in vertical alignment with the corresponding restraint head;

wherein two restriction tags extend downwardly from the main body for restraining the left-to-right direction of the plastic portion; and a stop tag and a guidance stud adjacent to the stop tag extend from the upper side of the main body, and the stop tag and the guidance stud respectively cover the guiding section and the projecting section of the latching arm; the stop tag is extending in vertical direction of the guidance stud and the main body's direction; during this extending from two opposite lengthwise ends of the housing, each of said latch arms defining a locking lug and a restraint head adjacent to and in front of said locking lug; and a daughter board being assembled to the housing via rotation to have an edge inserted into the slot and have electrical pads around said edge in contact with the contacts when said daughter board is locked in a horizontal position, the restraint head being dimensioned to be snugly compliant with but not larger than a corresponding notch of the daughter board in a top view, said locking lug being positioned above the daughter board and engaging an upper edge face of said daughter board when said daughter board is in the horizontal position; and a pair of metallic pieces each attached to the corresponding latch arm and co-movable with the latch arm for reinforcement, wherein at least one of said metallic piece and said restraint head is equipped with a projection section which is essentially snugly compliant with the notch of the daughter board in the top view but being located above the daughter board with a distance when said daughter board is in the horizontal position for performing a stopper function during an incorrect installation of the daughter board so that the daughter board can not deflect the latch arm outward for rotative installation if the daughter board is not correctly and completely inserted into the slot due to said projection section;

wherein said projection section is a stop tag extending from the metallic piece in vertical alignment with the corresponding restraint head;

wherein two restriction tags extend downwardly from the main body for restraining the left-to-right direction of the plastic portion; and a stop tag and a guidance stud adjacent to the stop tag extend from the upper side of the main body, and the stop tag and the guidance stud respectively cover the guiding section and the projecting section of the latching arm; the stop tag is extending in vertical direction of the guidance stud and the main body's direction; during this downward rotational movement of the daughter board, if the daughter board is positioned in the correct position, the side edges of the daughter board around the notches directly engage and impose the forces upon the guidance studs of the metal portions of the latching arms while without direct significant improper scrapping force imposed upon the locking lug; the metal portion together with the plastic portion can smoothly outwards deflected, the notches of the daughter board properly passed the stop tags, after the side edges slide off the guidance studs, the latching arms deflected back and the daughter board rotated downwardly to the final horizontal position.

5. The assembly as claimed in claim 4, wherein said projection section is integrally formed with the restraint head so as to result in a raised type restraint head.

6. The assembly as claimed in claim 5, wherein said metallic piece further defines a stop tag protectively covering the restraint head for preventing a corresponding side edge of the daughter board from scratching the restraint head when said daughter board is incorrectly and incompletely installed into the housing via rotation.

* * * * *